US009178307B2

(12) United States Patent
Papurcu et al.

(10) Patent No.: US 9,178,307 B2
(45) Date of Patent: Nov. 3, 2015

(54) CONNECTOR HAVING A HOUSING WITH A FIRST TOOTH SYSTEM ACTUATED BY A SECOND TOOTH SYSTEM ON A LEVER

(71) Applicant: DELPHI TECHNOLOGIES, INC., Troy, MI (US)

(72) Inventors: Necdet Papurcu, Datteln (DE); Joerg Schattling, Solingen (DE); Andreas Weidemeyer, Neukirchen (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/351,604

(22) PCT Filed: Oct. 25, 2012

(86) PCT No.: PCT/EP2012/071139

§ 371 (c)(1),
(2) Date: Apr. 14, 2014

(87) PCT Pub. No.: WO2013/060772

PCT Pub. Date: May 2, 2013

(65) Prior Publication Data

US 2014/0273565 A1 Sep. 18, 2014

(30) Foreign Application Priority Data

Oct. 26, 2011 (GB) ..... 1118499.1

(51) Int. Cl.
*H01R 13/62* (2006.01)
*H01R 13/629* (2006.01)
(Continued)

(52) U.S. Cl.
CPC ..... *H01R 13/62977* (2013.01); *H01R 13/533* (2013.01); *H01R 13/62938* (2013.01); *H01R 13/62944* (2013.01); *H01R 13/6271* (2013.01); *H01R 13/6295* (2013.01)

(58) Field of Classification Search
USPC ..... 439/157–160
See application file for complete search history.

(56) References Cited

U.S. PATENT DOCUMENTS 5,035,634 A * 7/1991 Hasircoglu et al. ..... 439/157
5,722,843 A * 3/1998 Kerckhof et al. ..... 439/157
(Continued)

FOREIGN PATENT DOCUMENTS

DE 199 33 933 A1 1/2001
DE 10 2009 027660 A1 1/2011
(Continued)

OTHER PUBLICATIONS

International Search Report dated Mar. 26, 2013.

*Primary Examiner* — Chandrika Prasad
(74) *Attorney, Agent, or Firm* — Robert J. Myers

(57) ABSTRACT

A connector system having a first connector and a second connector. The first and the second connector are moveable relative to one another along an axis in order to connect and disconnect the contacts of the first connector and the second connector. The first connector has a lever mounted at the pivot point and is pivotal around an angle. The lever has a surface extending in the circumferential direction and which extends substantially through the essentially along the same angle. The surface has a first planar section and a second section having a radially extending tooth system. The lever is movable from a first, second, and third position. The housing of the second connector has a complementary tooth system. The tooth systems become engaged when the lever is moved from the second to third position, thus moving the first connector and the second connector toward one another along the axis.

7 Claims, 6 Drawing Sheets

(51) Int. Cl.
*H01R 13/533* (2006.01)
*H01R 13/627* (2006.01)

(56) References Cited

U.S. PATENT DOCUMENTS

| | | | | |
|---|---|---|---|---|
| 6,325,647 | B1 * | 12/2001 | May et al. | 439/157 |
| 6,540,532 | B1 * | 4/2003 | Martin et al. | 439/157 |
| 7,568,925 | B2 * | 8/2009 | Ciriello et al. | 439/157 |
| 7,641,486 | B2 * | 1/2010 | Tonosaki | 439/157 |
| 7,749,004 | B2 * | 7/2010 | Shuey | 439/157 |
| 8,414,315 | B2 * | 4/2013 | Dekoski | 439/157 |
| 8,662,906 | B2 * | 3/2014 | Schmitt et al. | 439/157 |
| 2012/0115342 | A1 | 5/2012 | Schmitt et al. | |

FOREIGN PATENT DOCUMENTS

| | | | |
|---|---|---|---|
| DE | 10 2009 028333 | A1 | 2/2011 |
| EP | 1 077 512 | A2 | 2/2001 |
| EP | 2 110 895 | A1 | 10/2009 |

* cited by examiner

CONNECTOR HAVING A HOUSING WITH A FIRST TOOTH SYSTEM ACTUATED BY A SECOND TOOTH SYSTEM ON A LEVER

CROSS-REFERENCE TO RELATED APPLICATION

This application is a national stage application under 35 U.S.C. §371 of PCT Application Number PCT/EP2012/071139 having an international filing date of Oct. 26, 2012, which designated the United States, which PCT application claimed the benefit of Great Britain Patent Application Number 1118499.1, filed Oct. 26, 2011, the entire disclosure of each of which are hereby incorporated herein by reference.

TECHNICAL FIELD OF THE INVENTION

The present invention relates to a two-part electrical connector, which can be connected or disconnected by means of a lever.

BACKGROUND OF THE INVENTION

In the prior art, various embodiments of connectors are known. A connector can have two housings with contacts, which can be pulled together from a pre-assembly position into a final position by means of a lever arm pivotally mounted onto a housing. In doing so, the lever arm forms a bow relative to the housing. The lever arm comprises a surface from which a tooth system extends radially outwardly. The other housing has a corresponding tooth system on its surface. When the two housings are fitted together and the lever is moved, the tooth systems become engaged and the two connecting connectors are pulled towards each other along a connecting axis. When the lever arm is moved in the opposite direction, the two housings are pulled apart again by the teeth. As a result the contact elements within the housings are connected to each other when the two connecting connectors are brought together, and separated again when the two connecting connectors are pulled apart. The arrangement of the teeth on the lever and on the housing is essentially designed such that the teeth are continuously engaged. The teeth mesh as soon as the two connecting connectors are joined together.

This construction has the disadvantage that the angle which the lever describes when the two connecting connectors are joined is directly related to the distance that the two connecting connectors cover on their way toward each other. In connector systems, this distance is called the connector stroke, and it is usually shorter than the travel created by a lever movement through an angle of 180°. In practice, the angle of the lever, in the joined condition, amounts to only a few degrees to the plane of the contact elements. In order to achieve the correct stroke, the lever is aligned in a 90° angle to the plane of the contact elements, and the two connecting connectors are joined in this manner. The lever then moves only through approximately 90° to its end point, and the correct stroke is thus maintained.

In the wiring of vehicles, there is an increasing need to install multi-pin connector systems in vehicle compartments that are difficult to access. In this case the connector systems need to be designed as small as possible and, at the same time, provide a large number of contact elements. The result of development is connectors with a smaller height so that they fit through small openings and accommodate a large number of contact elements. When multi-pin connectors of this kind are assembled, a high insertion force is needed. In order to provide these high insertion forces, long lever arms are needed. In order to install these connector systems in confined spaces, the technician must be able to practically blindly connect and engage both connectors.

BRIEF SUMMARY OF THE INVENTION

The object of the invention is to provide a connector system that is easy to install and engage with reasonable force, despite its flat design and large number of contact parts.

This object is achieved by the fact that there is no interaction between the first connector of the connector system and the second connector of the connector system, as long as the lever moves between a first position and a second position.

This effect is achieved in that a section of the surface on the lever has no means which could engage in the teeth of the second connector. When the lever reaches the second position, the first tooth on the lever's surface engages with the teeth of the second connector. The teeth become frictionally locked and the housings are pulled towards each other along a connecting axis. The two tooth systems remain engaged until the lever has reached the third position, and the connector system is completely engaged. In this position, the lever is in its final position. When the system is to be disconnected again, the lever is rotated in the opposite direction, and the two connectors are forced apart by the teeth until the last tooth of the surface on the lever in the second position loses its frictional locking with the tooth system and returns to its original position without further moving the connectors.

The movement of the connectors towards or away from each other takes place exclusively when the lever moves in the section between the second position and the third position. The movement of the lever between the first and the second positions has no effect on the relative movement of the first and second connectors. The second position of the lever can be designed in such a way that both the insertion forces and the axial movement of the connectors relative to each other meets the requirements. As the location of the first position can be chosen across a wide range, this allows for further reduction of the height of the electrical connector. Thus, very flexible connectors can be designed for difficult installations.

Advantageous embodiments of the invention are described in the dependent claims, the description and the drawings.

According to one embodiment, the lever is substantially U-shaped and has a base portion and a pair of arms. The arms extend from the ends of the base portion and their ends are rotatably attached to the first connector.

Preferably each arm of the lever, adjoining its free ends, has a peripherally integrally molded surface. The surface can be formed during manufacture by injection molding in a mold. However, it is also possible to provide the structure by machining methods or hot-stamping methods.

In another embodiment, the lever has latching arms that serve to hold the lever on the first connector. By securing the lever to the housing, the lever is prevented from moving uncontrollably during assembly.

Advantageously, the tooth system of the surface has at least two teeth so that during locking of the connector the force can be distributed to the teeth while the connector is being closed. Naturally any known gear arrangements known from the prior art are suitable if they meet the technical requirements.

The surface preferably has a tooth system and the housing of the second connector has a complementary tooth system on the opposite side.

In another embodiment, the first section of the surface is limited by a stop on one side and on the other side by a tooth of the tooth system. The stop of the lever is placed onto the contact surface of the second connector when the two connectors are fitted together.

Preferably the lever has a rib positioned coaxially with the pivot point, a rib which extends radially from the pivot point along an angle and is offset by 180° with respect to the first section. The rib pushes apart the cams which rest on the supporting surfaces and prevent the two connectors from being brought together.

In a particularly advantageous embodiment, the material thickness of the rib increases along the extension angle in the first section remains the same in the second section and decreases again in a third section. This ramp shape ensures that the cam is lifted smoothly over the supporting surfaces.

Preferably, the lever is mounted on the first housing.

Advantageously, the first connector has a frame that is connected to the first housing and in which the lever is pivotally mounted. A peripheral frame can support the mechanism and accommodate the latch functions.

The frame preferably is connected releasably or non-releasably to the first housing. The frame can be manufactured in one piece together with the housing, subsequently glued or welded together or connected by detachable means such as screws, bolts, or snap connections.

Preferably, the frame has an elastic element on which a cam is mounted. The elastic element can be a spring or compressed elastic material, such as a spring-tongue, observed here by way of example. The cam can have any sensible shape.

A further embodiment relates to a cable harness comprising a connector according to the invention and connecting wires. The cable harness is particularly suitable for installation in confined spaces.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
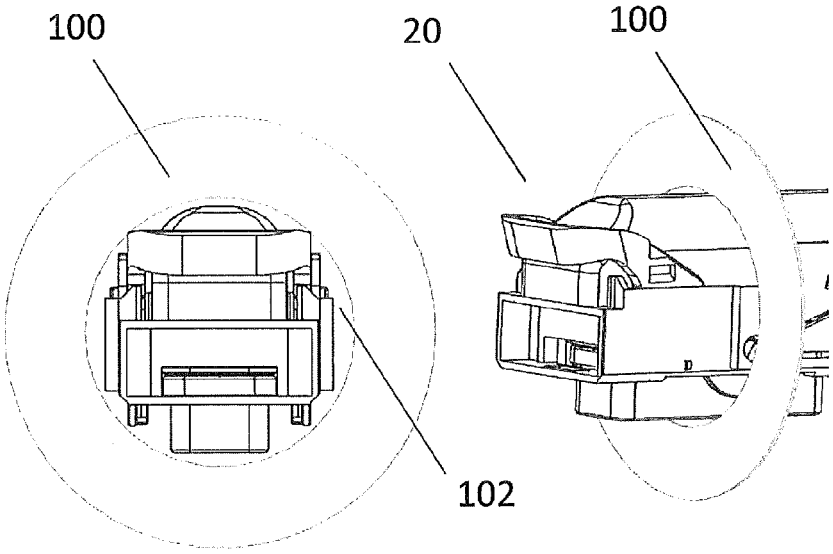
FIG. 1 shows a schematic drawing of a connector that is inserted through an opening in a sheet metal wall.

FIG. 1 shows a first connector 20 which is inserted through an opening 102 in a sheet metal wall 100. It can be seen from this drawing why it is necessary to provide a connector which is flat and in which the lever in the inoperative position lies approximately in the plane of the contact elements and does not protrude from the first connector 20 transversely to the opening 102.

Figure 2:
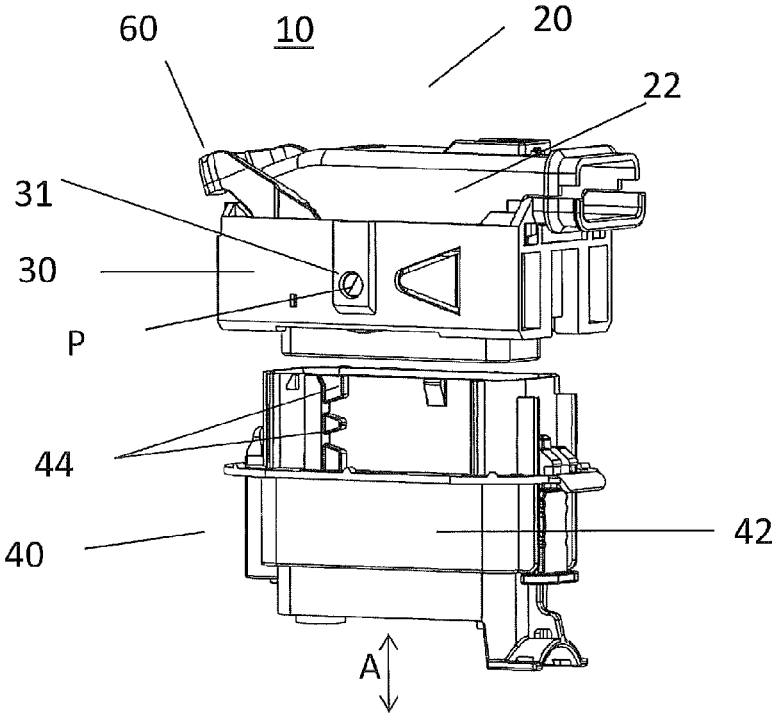
FIG. 2 shows a perspective view of the connector system according to the invention.

FIG. 2 shows the connector system 10 according to the invention. The first connector 20 comprises a first housing 22, the lever 60 and the frame 30; the lever 60 is mounted pivotally around pivot point P. The second connector 40 comprises a second housing 42 that has a first tooth system 44 on its surface.

Figure 3:
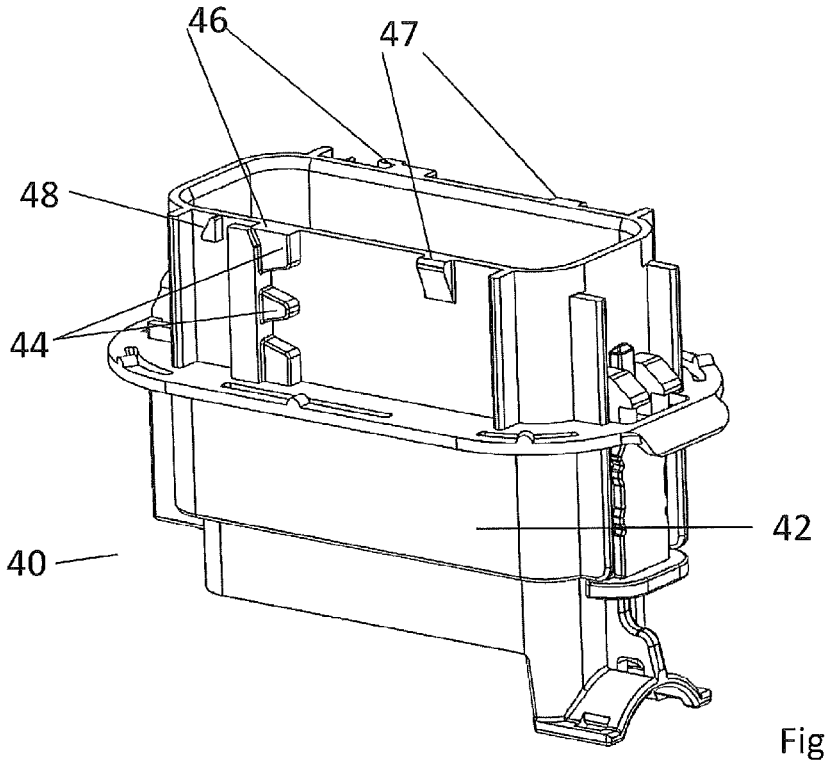
FIG. 3 shows a perspective view of the lower connector of the connector system according to the invention.

FIG. 3 shows a perspective view of the second connector 40. The upper area shows two supporting areas, 46 and 47, on which, when fitted together, the first connector 20 rests during the connecting process. The supporting areas 46 are provided for the lever 60, and the supporting areas 47 are provided for the cams 36 in the frame 30. The unlatching slope 48 serves to separate the latching arm 66 from the first connector 20. This occurs at the same time the first connector 20 is placed onto the second connector 40. The first tooth system 44 is provided for engagement in the second tooth system 65 of the lever 60.

Figure 4:
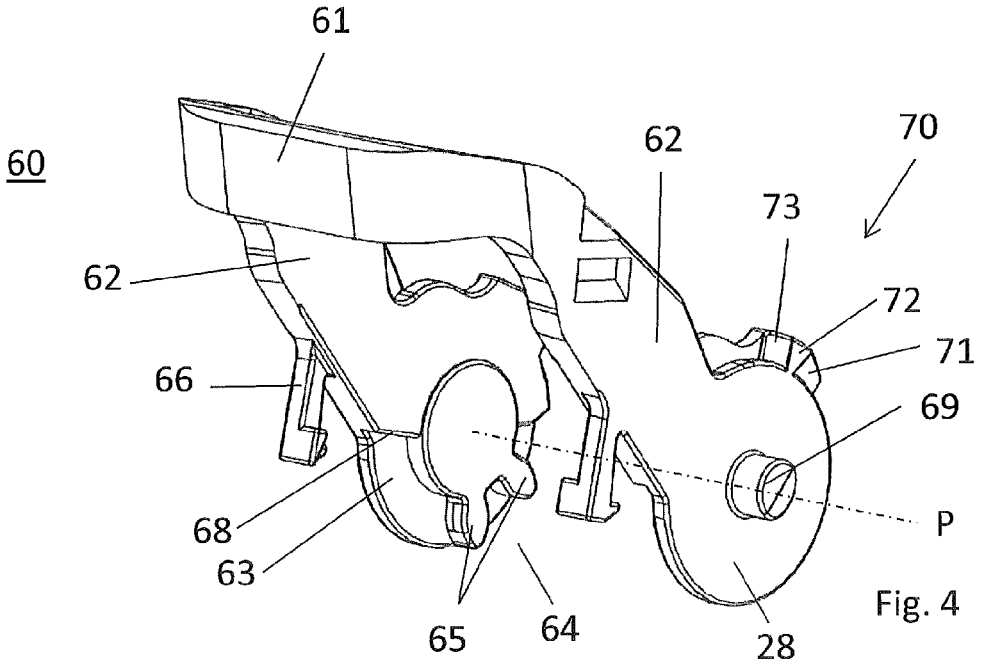
FIG. 4 shows a perspective view of the lever of the connector system according to the invention.

FIG. 4 shows a perspective view of the lever 60 of the connector system 10 according to the invention. The lever 60 has a base 61 from the ends of which two arms 62 extend. At the ends of the arms two surfaces 28 are formed. At the center of each surface 28 there is a pivot 69; together with the opening 31 in the first connector, the pivots 69 form a pivot bearing for the lever 60. The surfaces 28 have a flat section 63 and a section with a second tooth system 65. The toothed section 64 has at least two teeth. Protruding from each of the arms 62 is a latching arm 66, which holds the lever 60 on the first housing 22 when the first and second connectors 20, 40 are not connected. A rib 70 extends radially from the pivot point P, from each surface 28. The rib 70 is rotated by about 180° with respect to the flat section 63, about the pivot point P. The rib 70 increases in thickness in the first section 71, has a constant thickness in the second section 72 and decreases in thickness in the third section 73.

Figure 5:
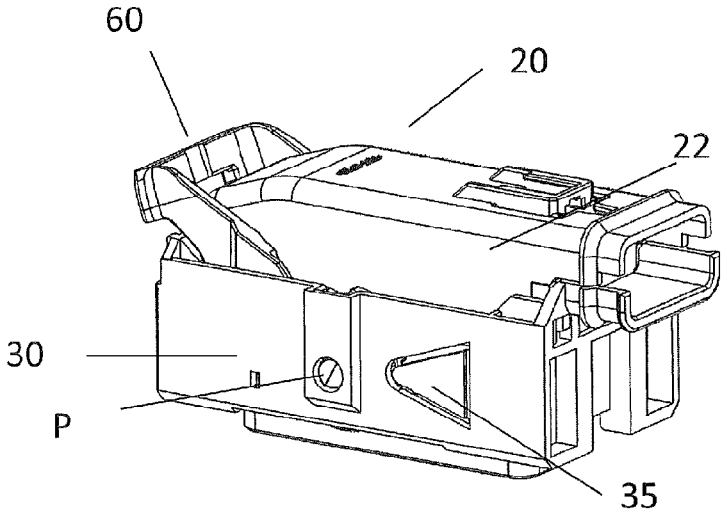
FIG. 5 shows a perspective view of the first connector of the connector system according to the invention.

FIG. 5 shows a perspective view of the first connector 20 of the connector system 10. The first connector 20 comprises a frame 30 which has an elastic element 35. The elastic element 35 is designed as a spring-tongue in this drawing. The side of the tongue facing towards the first housing 22 has a cam 36 attached. The cam 36 rests on the supporting area 47 of the housing when the first connector 20 is placed onto the second connector 40. In the embodiment shown, the opposing side of the frame also has an elastic element 35 with an integrally formed cam 36. The lever 60 is guided, with the pivots 69, into an opening 31 in the frame and pivotally mounted at point P.

Figure 6:
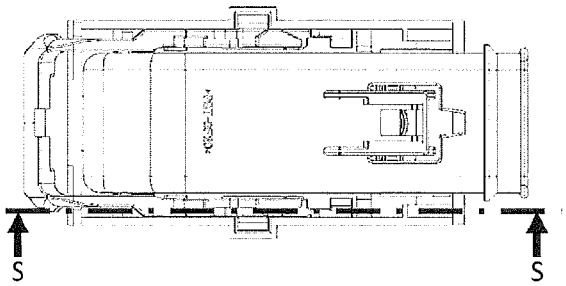
FIG. 6 shows the top view of the first connector of the connector system according to the invention, in which the cut edge of the cross-sectional view shown in FIG. 7 can be seen.
Figure 7:
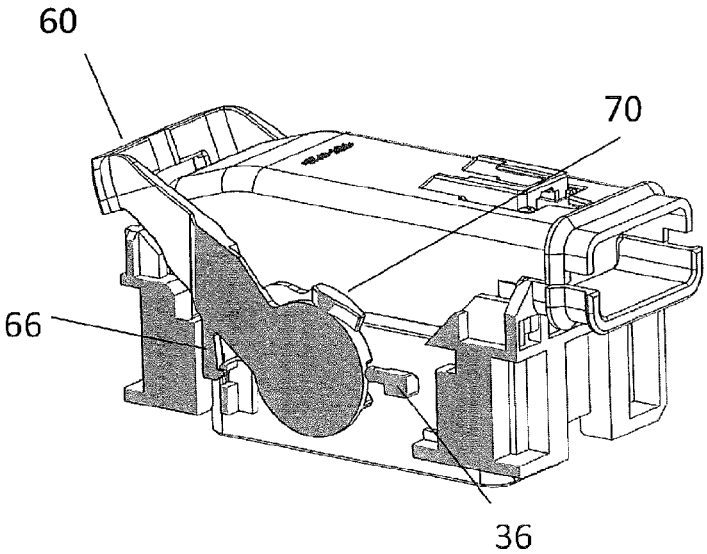
FIG. 7 shows a cross-sectional view of the first connector of the connector system according to the invention, in which the latching system of the lever can be seen.

FIG. 6 shows the section line for the cross-sectional view of the first connector in FIG. 7. The section runs along the section axis S.

FIG. 7 shows a cross-sectional view of the first connector 20 of the connector system 10 according to the invention, in which the latching system of the lever 60 can be seen. During assembly of the first connector 20 of the connector system 10, the lever 60 is attached by the latching arms 66 to the first connector 20. After the first connector 20 has been placed in its designated location on the second connector 40, the latching arms 66 are released from the first connector 20 by the unlatching slope 48, and the lever 60 is rotatable at pivot point P. When the lever 60 then moves from the second position to the third position, the ribs 70 push the cams 36, which are located on the elastic element, outward, and the first connector 20 slides over the supporting areas 47 onto the second connector 40 and can now be placed into the end position through use of the lever 60.

Figure 8:
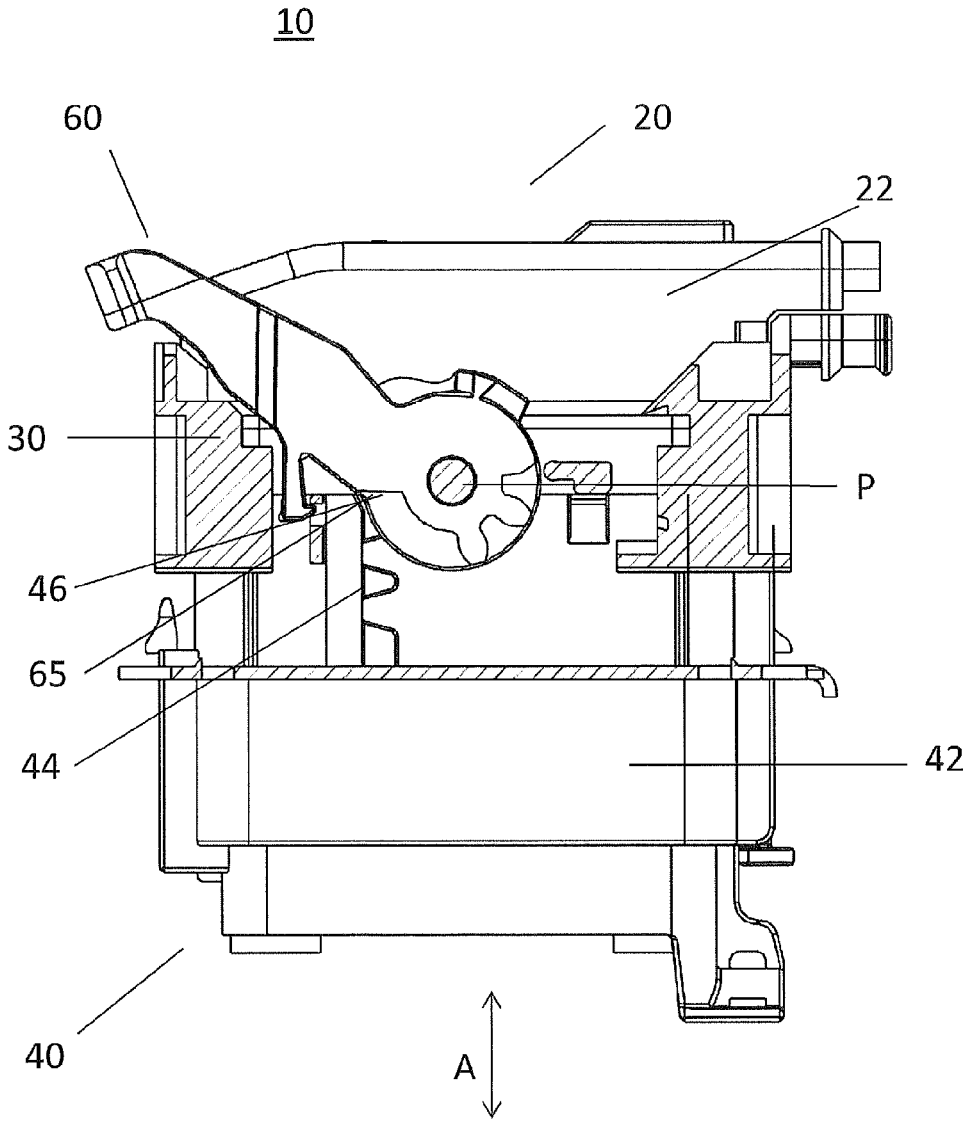
FIG. 8 shows a cross-sectional view of the connector system according to the invention, in which the two connectors can be seen in the mounted position.

FIG. 8 shows a sectional view of the connector system 10 of the invention, in which the first and second connectors 20, 40 can be seen in the position mounted one on top of the other. The cams 36 rest on the supporting areas 47 and the lever 60 is unlocked and can be rotated.

Figure 9A:
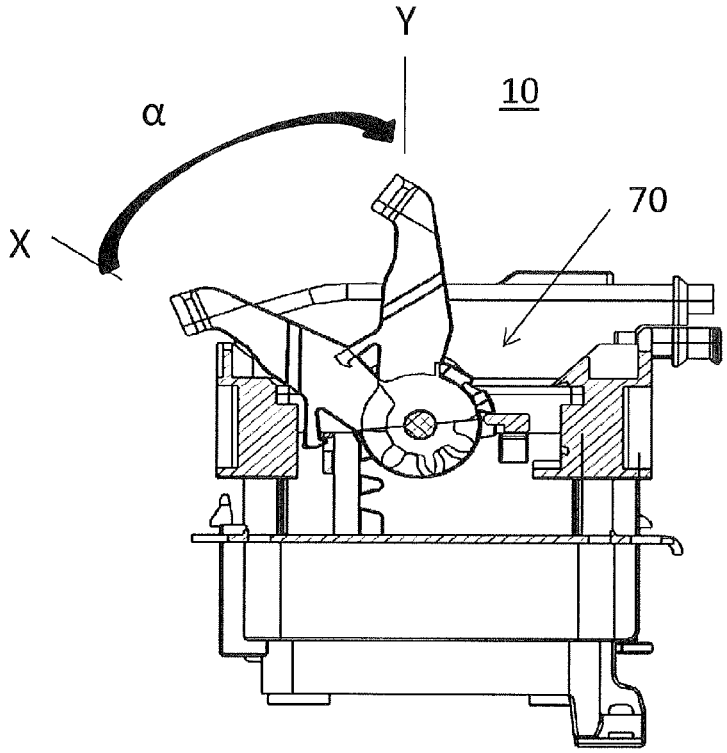
FIG. 9*a* shows a cross-sectional view of the connector system according to the invention, illustrating the manner of operation of the lever in the section between the first and the second positions.

FIG. 9*a* shows a cross-sectional view of the connector system 10 according to the invention, revealing both first and second connectors 20, 40 in the mounted position. The cams 36 rest on the supporting areas 47 and the lever 60 is unlatched and can be rotated. The lever 60 is swiveled from the first position X to the second position Y. Since the first and second tooth systems 65, 44 of the lever 60 and the second housing 42 are not engaged, the first and second connectors 20, 40 do not move relative to each other. In position Y, the rib 70 pushes the cam 36 away from the second housing 42, thus making it possible for the first connector to slide over the supporting areas 47.

Figure 9B:
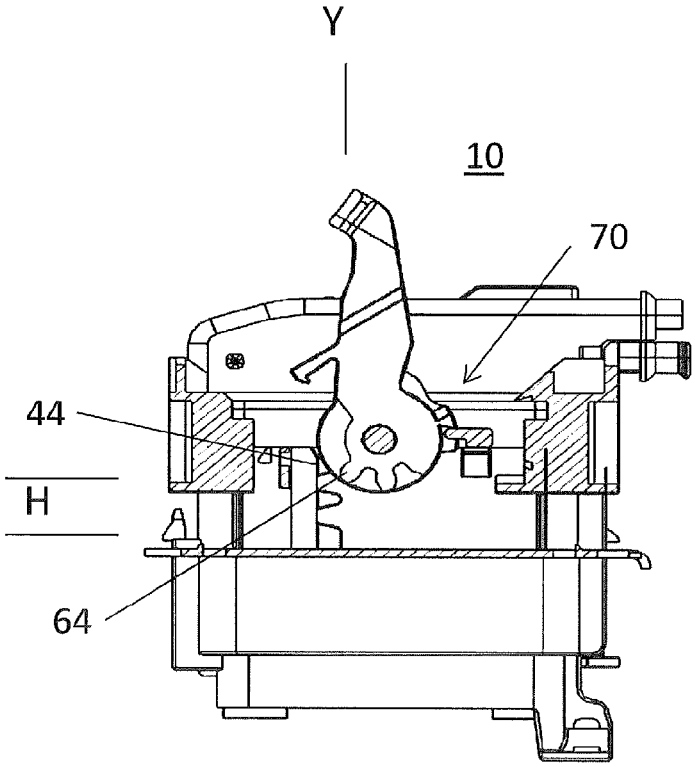
FIG. 9*b* shows a cross-sectional view of the connector system according to the invention in the position in which frictional locking between the tooth systems begins.

FIG. 9*b* shows a cross-sectional view of the connector system 10 according to the invention in the position in which frictional locking between the first and second tooth systems 44, 65 begins. In this Y position, the first tooth of the lever 60 engages with the first tooth of the second housing 42, and the first and second connectors 20, 40 start moving toward one another. The rib 70 continues to push the cam 36, so that the first connector can slide across the supporting area 47. At this point, the first and second connectors 20, 40 are located at the distance H corresponding to the angle that the lever will cover up to its final point Z.

Figure 9C:
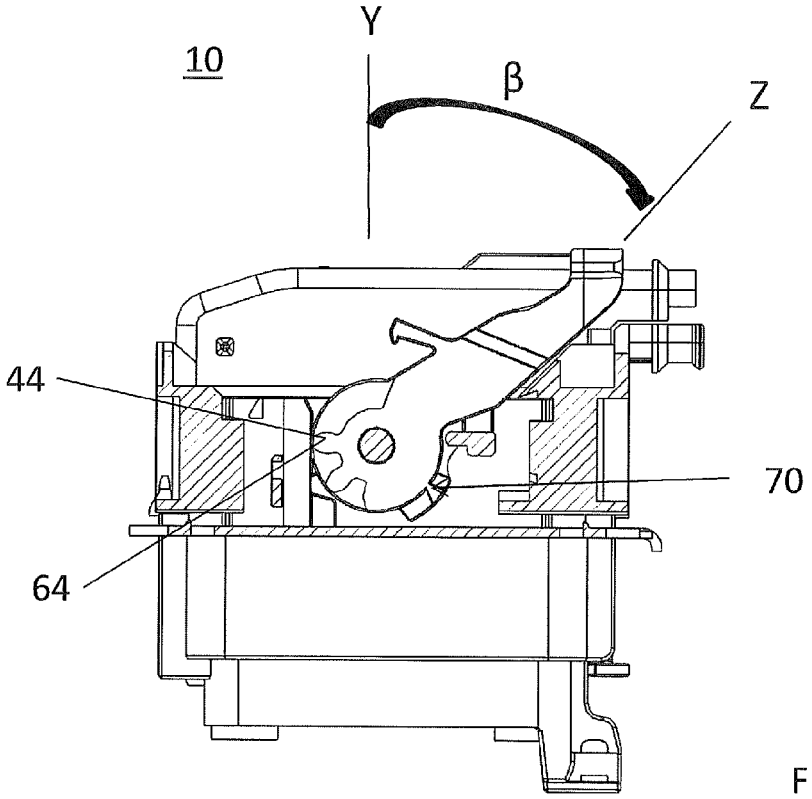
FIG. 9*c* shows a cross-sectional view of the connector system according to the invention, illustrating the connector system in its completely closed position.

FIG. 9*c* shows a cross-sectional view of the connector system 10 according to the invention, illustrating the connector system in its completely closed position. The lever 60 is in its final position Z. The first and second tooth systems 44, 65 are completely engaged. The rib 70 is no longer pushing the cam 36 aside. An optional locking mechanism for the lever 60 can be included.

The invention claimed is:

1. A connector system, comprising:

a first connector having a first housing with a first plurality of electrical contacts attached therein;

a second connector having a second housing with second plurality of electrical contacts attached therein, wherein the second housing defines a first tooth system and wherein the first and second connectors are moveable relative to one another along an axis in order to connect and disconnect the first plurality of electrical contacts and the second plurality of electrical contacts;

a frame is connected to the first housing; and a lever rotatably mounted to the frame, wherein the frame includes a cam mounted on an elastic element extending inwardly from the frame and configured to rest on a supporting area of the second housing when a first connector is placed on the second connector, wherein the lever has a surface extending radially from the pivot point, the surface having a substantially planar flat section and a toothed section defining a complementary second tooth system, wherein the lever defines a rib which extends radially from the pivot point and is offset with respect to the flat section, wherein when the lever is moved from a first position to a second position, the cam rests on the supporting area and the first and second tooth systems are not engaged, thus the first and second housings cannot be moved toward one another along the axis, and wherein when the lever is moved further in the same direction from the second position to a third position, the rib pushes the cam outwardly away from the second housing allowing the first and second tooth systems to be engaged, thus moving the first and the second housings toward one another along the axis.

2. The connector system according to claim 1, wherein the lever is substantially U-shaped having a base portion and a pair of arms which extend from the base Portion.

3. The connector system according to claim 1, wherein the lever has latching arms configured to hold the lever in the first position until released by contact with unlatching slopes defined by the second housing.

4. The connector system according to claim 1, wherein the second tooth system has at least two teeth.

5. The connector system according to claim 1, wherein the flat section of the surface of the lever is delimited by a stop on one side and by a tooth of the second tooth system on the other side.

6. The connector system according to claim 1, wherein the rib is offset by 180° with respect to the flat section.

7. The connector system according to claim 1, wherein the material thickness of the rib increases along a first section of the rib, remains constant in a second section of the rib and decreases in a third section of the rib.

* * * * *